US011278961B2

(12) United States Patent
Archer

(10) Patent No.: US 11,278,961 B2
(45) Date of Patent: Mar. 22, 2022

(54) CONTAINMENT FOR HOT ISOSTATIC PRESSING AND VACUUM DEGASSING APPARATUS

(71) Applicant: SAGITTITE LIMITED, Wolverhampton (GB)

(72) Inventor: Geoffrey Frederick Archer, Stamford (GB)

(73) Assignee: SAGITTITE LIMITED, Wolverhampton (GB)

( * ) Notice: Subject to any disclaimer, the term of this patent is extended or adjusted under 35 U.S.C. 154(b) by 0 days.

(21) Appl. No.: 16/869,788

(22) Filed: May 8, 2020

(65) Prior Publication Data

US 2020/0261978 A1 Aug. 20, 2020

Related U.S. Application Data

(63) Continuation of application No. 16/097,346, filed as application No. PCT/GB2017/051213 on Apr. 28, 2017, now abandoned.

(30) Foreign Application Priority Data

Apr. 29, 2016 (GB) ..... 1607512

(51) Int. Cl.

| | |
|---|---|
| ***B22F 3/12*** | (2006.01) |
| ***B22F 3/15*** | (2006.01) |
| ***B30B 11/00*** | (2006.01) |

(52) U.S. Cl.

CPC ..... *B22F 3/1208* (2013.01); *B22F 3/15* (2013.01); *B30B 11/001* (2013.01); *B22F 2003/153* (2013.01); *B22F 2201/20* (2013.01)

(58) Field of Classification Search

CPC .... B22F 3/12; B22F 3/15; B22F 3/153; B22F 3/1208; B22F 2003/153; B30B 11/00; B30B 11/001

See application file for complete search history.

(56) References Cited

U.S. PATENT DOCUMENTS

| | | | |
|---|---|---|---|
| 3,160,502 | A | 12/1964 | Quartullo |
| 4,104,061 | A | 8/1978 | Roberts |

(Continued)

FOREIGN PATENT DOCUMENTS

| | | | |
|---|---|---|---|
| GB | 2208389 | A | 3/1989 |
| JP | S62182202 | A | 8/1987 |

(Continued)

OTHER PUBLICATIONS

International Search Report for PCT/GB2017/051213 dated Jul. 11, 2017 (5 pages).

(Continued)

*Primary Examiner* — Joseph S Del Sole
*Assistant Examiner* — Thu Khanh T Nguyen
(74) *Attorney, Agent, or Firm* — Bookoff McAndrews, PLLC

(57) ABSTRACT

A containment for use in hot Isostatic pressing, the containment comprising a body formed from sheet material and fused together along its longitudinal length using a backing strip on the outside of body. Also a containment with a body and top and bottom caps diffusion bonded upon hot isostatic pressing, a containment with a gas purge inlet and outlet and an apparatus for vacuum degassing are disclosed.

10 Claims, 3 Drawing Sheets

(56) References Cited

U.S. PATENT DOCUMENTS

| | | | | |
|---|---|---|---|---|
| 4,178,178 | A | 12/1979 | Garvare | |
| 4,904,538 | A | 2/1990 | Juhas | |
| 4,980,126 | A | 12/1990 | Juhas | |
| 5,903,813 | A | 5/1999 | Moxson et al. | |
| 6,106,765 | A | 8/2000 | Lee et al. | |
| 10,035,189 | B2 | 7/2018 | Boswell | |
| 2007/0228596 | A1* | 10/2007 | Fujikawa | B30B 11/002 264/85 |
| 2009/0142221 | A1 | 6/2009 | Strangman | |
| 2016/0045981 | A1* | 2/2016 | Zurecki | B33Y 30/00 219/76.12 |

FOREIGN PATENT DOCUMENTS

| | | | |
|---|---|---|---|
| JP | H02182805 | A | 7/1990 |
| JP | H03207802 | A | 9/1991 |
| JP | H06345545 | A | 12/1994 |

OTHER PUBLICATIONS

Boardman, H.C., "Design of Welded Joints," Welding Handbook, 3rd Ed., Ch. 39, pp. 871-881 (1950).

Buekenhout, L. et al., "Hot Isostatic Pressing of Metal Powders," *Key Engineering Mater.*, vol. 29-31, pp. 207-224 (1989).

Kalyuzhnyi, V. et al., "Design of Copper Backing Pieces for One-sided Welding Straight Welded Joints," *Welding Intl.*, vol. 8, pp. 311-315 (1994).

Price, P.E. et al., "Hot Isostatic Pressing of Metal Powders," Metals Handbook: Powder Metallurgy, pp. 419-443 (1984).

* cited by examiner

CONTAINMENT FOR HOT ISOSTATIC PRESSING AND VACUUM DEGASSING APPARATUS

CROSS-REFERENCE TO RELATED APPLICATIONS

This application is a continuation of U.S. application Ser. No. 16/097,346, filed on Oct. 29, 2018, which is the U.S. national stage entry under 35 U.S.C. § 371 of International Application No. PCT/GB2017/051213, filed on Apr. 28, 2017, each incorporated by reference herein in its entirety, PCT/GB2017/051213 claiming benefit of priority to GB Application No. 1607512.9, filed on Apr. 29, 2016.

BACKGROUND

Hot Isostatic pressing is a manufacturing process that uses high temperatures and pressures to provide engineering components with tightly defined material properties. Hot Isostatic pressing has been used since the 1970's to reduce the porosity of metals and increase the density of ceramic materials. Hot Isostatic pressing conventionally relies on argon gas to Isostatically increase gas pressure on the outside of a containment or component to be consolidated. Argon is commonly used as it is inert and will not chemically react with materials and containments placed within the hot isostatic furnace.

The success of hot Isostatic pressing to a large extent is reliant on a fundamental understanding of materials engineering and how hot Isostatic pressing works. For example, the containment design and tailoring of the hot Isostatic pressing parameters consolidate and optimise the properties of the materials within the containment is fundamental to whether the manufactured component is within the set properties and tolerances.

The inventions described herein seek to solve problems that have been inherent with the use of hot Isostatic pressing to manufacture engineered components.

SUMMARY OF THE INVENTION

An aspect of the present invention provides a containment for use in hot Isostatic pressing, the containment comprising a body formed from sheet material and fused together along its longitudinal length using a backing strip on the outside of body.

In some embodiments the containment may further comprise a vent penetrating from outside of the containment body into a void between the containment body and the backing strip.

Provision of a vent from the outside of the containment body to the void between the containment and the backing strip is highly advantageous as the vent provides a means of escape for any gas trapped between the containment body and the backing strip.

Another aspect of the invention provides a containment comprising a body sealed at both ends by self-sealing weld joints defined by return flanges.

Prior to commencing the hot isostatic pressing process it is critical that the containment is vacuum sealed to minimise the risk of containment failure during the hot Isostatic pressing process. The use of self-sealing weld joints defined by return flanges is advantageous as it minimises the amount of weld material required to seal the containment. The return flanges self-seal under pressure hence any leak through the weld would be addressed when the containment is under pressure during the hot Isostatic pressing process.

Another aspect of the invention provides a containment for use in hot Isostatic pressing, the containment comprising a body sealed at both ends, at least one gas purge pipe defining a gas passage from outside of the containment to inside of the containment and at least one gas evacuation pipe defining a gas passage from outside of the containment to inside of the containment, wherein the at least one gas purge pipe and at least one gas evacuation pipe define a gas passage through the containment which extends from the gas purge pipe to the gas evacuation pipe.

Prior to hot Isostatic pressing, metal powder within the containment requires cleansing to remove any impurities or substances that could affect the final chemical structure of the material. The degassing processes described herein involve the purging of an inert gas through at least one gas purge pipe to cleanse the material followed by the evacuation of any gas in the containment through at least one gas evacuation pipe. The at least one gas purge pipe and at least one gas evacuation pipe are orientated to define a gas passage through the containment and thus through the metal powder to enable gas to permeate between individual particles of the metal powder.

Another aspect of the invention provides an apparatus for vacuum degassing a metal powder within a containment, the apparatus comprising an oven for heating the metal powder within the containment, a vacuum pump for evacuating gas from the metal powder within the containment and a gas source for purging the metal powder within the containment, wherein purging and evacuation of the metal powder within the containment is controlled by a plurality of valves operable to control provision of gas from the gas source to the containment and provision of a vacuum from the vacuum pump to the containment.

FIGURES

The following figures illustrate examples of embodiments of the inventions described herein:

Figure 4A:
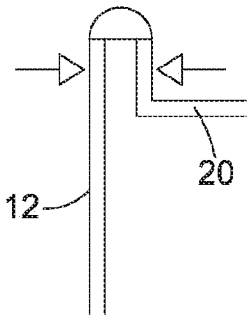
Figure 4B:
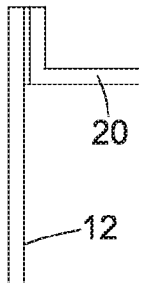
Figure 5:
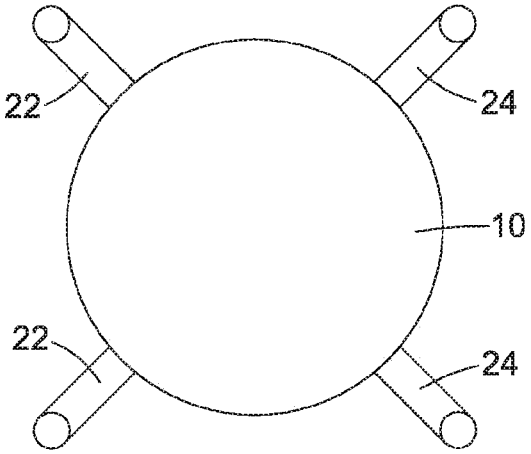
Figure 6:
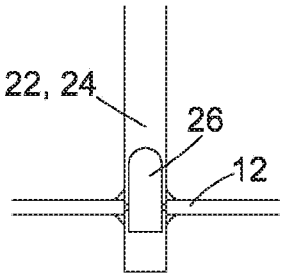
Figure 7:
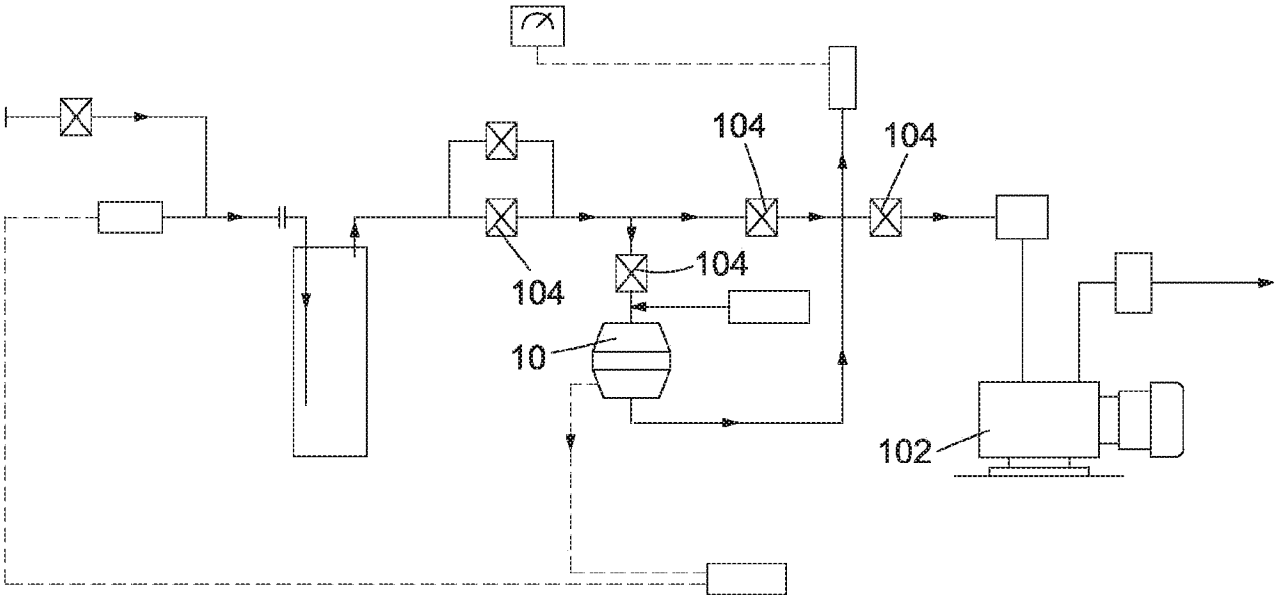

FIGS. 4*a* and 4*b* illustrate a weld closure used to seal the ends of the containment;

FIG. 5 shows a containment comprising gas purge pipes and gas evacuation pipes;

FIG. 6 shows a detailed view of the internal aspect of the gas purge pipes and gas evacuation pipes of FIG. 5;

FIG. 7 shows a schematic of a vacuum degassing apparatus according to aspects of the invention.

DESCRIPTION

Aspects of the invention will now be described by way of reference to the figures.

Figure 2:
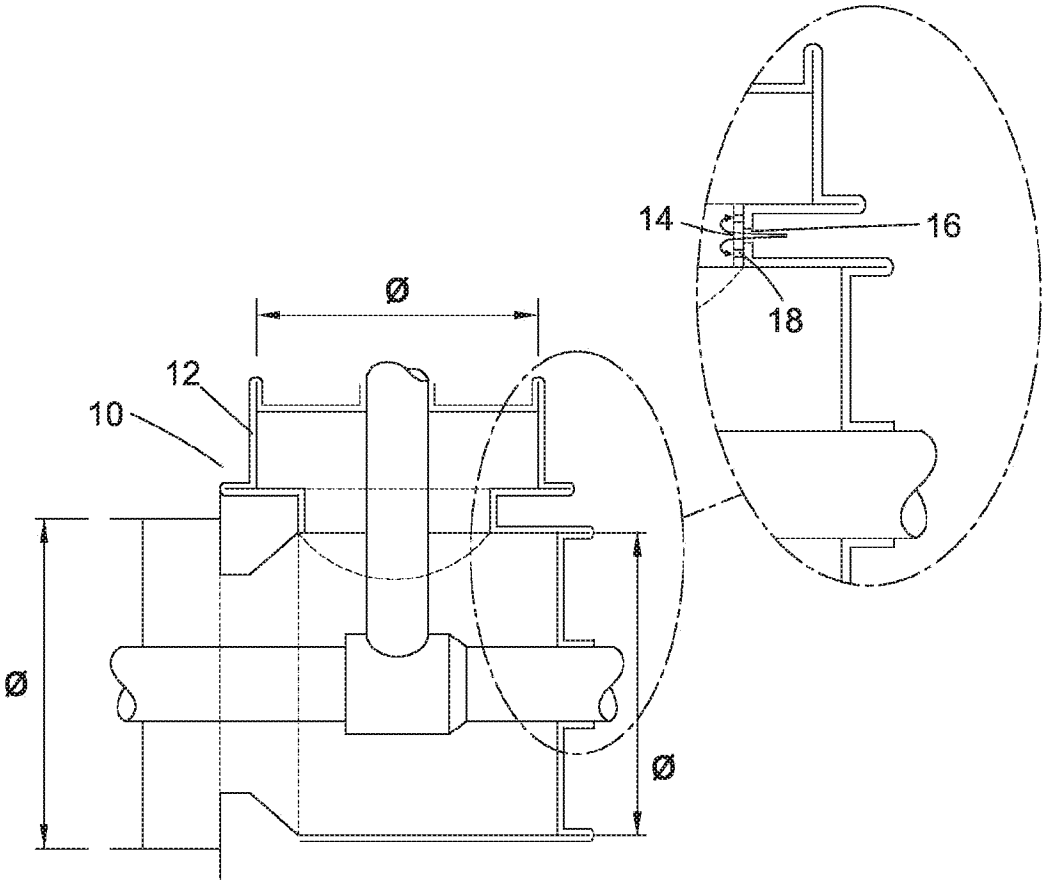
FIG. 2 shows a more complex containment according to aspects of the invention.
Figure 1:
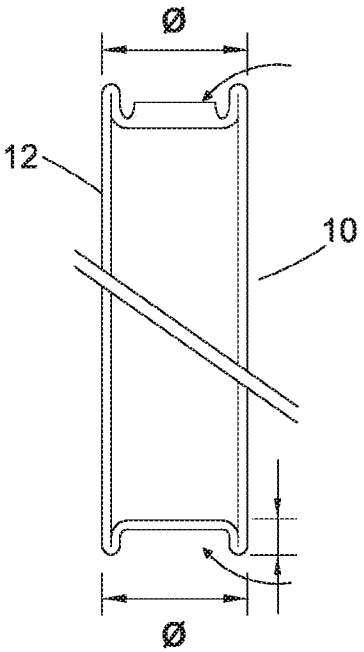
FIG. 1 shows a simple cylindrical containment according to aspects of the invention.

A suitable containment (10) is required for hot Isostatic pressing as illustrated in FIGS. 1 and 2. Such a containment (10) would typically be manufactured from sheet metal such as stainless steel or mild steel. Prior to manufacture the containment (10) material is subjected to suitable hot and cold working to alter its material properties such that the containment (10) material is stronger than the weld metal which is used to fabricate the containment (10). Stainless steel containments (10) require the sheet material to be annealed in a vacuum furnace following forming and bending and prior to fabrication to prevent fracture of the material during the early stages of hot Isostatic pressing. Hot Isostatic pressing, as described below, requires very high temperatures which will put metal powders, and in some embodiments the containment (10) itself in a super plastic condition. The material used to manufacture the containment (10) must be of a suitable grade to support the powder when the powder and containment (10) are in a super plastic condition.

Containments (10) of all shapes and sizes can be manufactured for use with embodiments of the present invention. FIG. 1 shows a simplified view of a cylindrical containment (10) adapted for use with the filling, vacuum degassing and hot Isostatic pressing processes described herein. The containment (10) comprises a sheet metal body (12) formed to have an internal surface profile designed to be near to the final external shape of an engineering component to be formed using a hot Isostatic pressing process. In some embodiments the containment (10) must be supported by a fixture to take into account volume change during consolidation of the powder while providing support to the containment (10). The fixture is typically formed from two inch box section and positioned external to the containment between the ends of the containment. The fixture permits controlled deformation of the containment while preventing total collapse of the containment.

Figure 3:
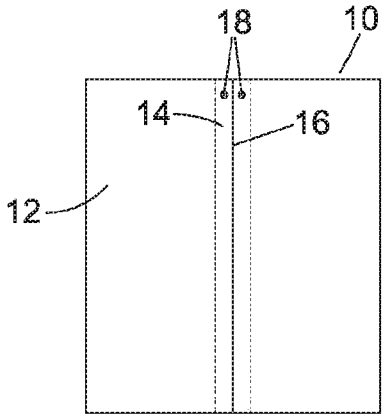
FIG. 3 illustrates a view from the inside of a containment formed from sheet metal and joined by welding using a backing strip.

The sheet metal body (12) in FIG. 1 has a cylindrical shape which is formed using butt welds to join ends of the sheet metal material together to form the final shape of the containment (10). Each butt weld is made using a weld backing strip (14), as shown in FIG. 3, which is welded to the outside of the containment body (12) by TIG welding. The backing strip (14) spans either side of the joint (16) between ends of the containment body (12). In some embodiments the backing strip (14) is tacked around its circumference to the containment body (12). In other embodiments the backing strip (14) is continuously welded around its circumference to the containment body (12). A containment body (12) having a continuously welded backing strip will necessarily define a void between the containment body (12) and backing strip (14). To vent the void between the containment body (12) and backing strip (14), a small hole is provided through the backing strip (14) either side of the joint (16) into the void. Any air trapped in the void is vented into the containment (10) through the joint (16). Each hole (18) has a minimum diameter of two millimetres. Once the weld backing strip (14) is in place and vented the ends of the sheet material (12) are welded together using TIG welding from the inside of the containment (10) to fully penetrate the sheet material (12) and join to the weld backing strip (14).

The containment (10) design for cylindrical type components can be consolidated from either the inside or the outside. For example, a solid core, coated as necessary with boron nitride, can be used as a near net shape former for the internal diameter of a component and a thin outer containment can be used as a movable outer membrane to take up the entire change in volume of the powder as it consolidates. Conversely, it is also possible to consolidate the containment (10) design from the inside of a cylinder using a thick outer cylinder and a thin movable membrane on the inside of the cylinder.

FIG. 2 illustrates a more complex containment (10) which follows the same general design principles as the containment shown in FIG. 1.

Care must be taken when designing the containment (10) to consider the coefficient of thermal expansion of the consolidated powder and the containment (10) material during cooling. This, in conjunction with the hot Isostatic pressing parameters, must be tailored to allow the consolidated powder and containment (10) to cool with minimal induced stress created by a coefficient of thermal expansion mismatch.

In the case of cladding, particularly with Ni based alloys containing B (Sagittite® 10 and 15), it is essential to place a nickel foil of not less than 0.5 mm between the powder and the substrate material to act as a filter for B. This prevents the formation of Ferro-Boride at the cladding interface, which will possibly extend down the substrate grain boundaries totally prohibiting the sold state diffusion of the Sagittite® to the steel substrate.

In many cases the purpose of cladding a component is to enhance either wear, corrosion and/or strength properties. In such cases, and in particular with nickel based alloys, the consolidated cladding will exhibit a significantly different coefficient of thermal expansion and will have a much higher hot strength. It is therefore essential to allow the temperature to dwell at a suitable stress relieving temperature to allow the substrate/containment to relax to the cladding material.

The ends (20) of the containment (10) are formed from sheet material with flanged closure joints. FIG. 4 illustrates closure of a simple containment (10). The ends (20) of the containment (10) are positioned relative to the containment (10) such that the flange parts of the ends of the containment (10) are orientated outwardly from the containment (10). The end of each flange is aligned with the end of the containment (10) and welded to the containment (10). The weld provides a temporary seal to maintain the integrity of the containment (10) during vacuum degassing. During hot Isostatic pressing the pressure exerted on the containment (10) urges the flanges of the ends (20) of the containment towards the sheet metal body of the containment and causes the flanges of the ends (20) of the containment (10) to diffusion bond to the containment (10).

During hot Isostatic pressing the welds of the containment (10) are subjected to the full pressure of gas pressurised therein. To minimise the risk of weld failure each weld used during fabrication of the containment has a crown to root thickness greater than the sheet material. The welds must not exhibit root piping. It is preferred that all welds used are either lap joints or self-sealing joints. All welds used on lap joints and self-sealing joints are rounded as shown in FIG. 4, for example.

The containment (10) is provided with at least one gas purge pipe (22) and at least one gas evacuation pipe (24). Each gas purge pipe (22) and gas evacuation pipe (24) is inserted through an opening in the containment (10) and welded to the containment (10). A bullet (26) is inserted into each gas purge pipe (22) and gas evacuation pipe (24), as shown in FIG. 6, and welded thereto in the region of the opening through the containment (10). The bullet (26) allows gas to pass through the gas purge pipe (22) or gas evacuation pipe (24) while preventing powder from being drawn from the containment (10). The bullet (26) also prevents collapse of the gas purge pipe (22) or gas evacuation pipe (24) during subsequent hot Isostatic pressing.

Many engineering components have an internal bore. To form such an internal bore using hot Isostatic pressing a mandrel is used in the containment (10) around which metal powder is filled. In certain circumstances the mandrel may be coated with an aqueous suspension of boron nitride.

Once the containment (10) has been filled with an appropriate metal powder it is closed and the containment (10) is connected to vacuum degassing apparatus (100), as shown schematically in FIG. 7, within an open atmospheric air circulating oven. Smaller containments (10) are closed by welding an end cap to the containment (10). Larger containments have bespoke filling ports that are closed following filling and sealed by welded. The vacuum degassing apparatus (100), as shown in FIG. 6, comprises a rotary pump (102) for generating a vacuum. The rotary pump (102) is operably coupled to a containment (10) by way of one or more gas evacuation pipes (24). A series of valves (104) are located between the rotary pump (102) and the containment (10) for selectively applying a vacuum to the containment (10). At least one pressure sensor and at least one temperature sensor are associated with the containment (10) to measure and record temperature and pressure therein. The vacuum degassing apparatus (100) is positioned in an oven (not shown) prior to use. The gas purging procedure effectively scrubs the metal powder to remove any contaminants and impurities therefrom prior to the hot Isostatic pressing process.

As described above, the containment (10) has a plurality of gas purging pipes (22) and a plurality of gas evacuation tubes (24). Generally, each gas purging pipe (22) is diagonally opposite a gas evacuation pipe (24) or otherwise strategically placed to encourage gas within the containment (10) to follow a path through the powder. The vacuum degassing apparatus (100) is operatively connected to the containment (10) such that a gas source such as helium is connected to one or more of the gas purging pipes (22) and the rotary pump (102) is operably connected to one or more of the gas evacuation pipes (24). In all cases, where the vacuum degassing apparatus (100) is connected to a gas purging pipe it is always connected to at least one gas evacuation pipe (24).

The use of pure helium in the initial gas purge during degassing process activates chemically bonded substances on the surface of the metal powder. Subsequent gas purges during the vacuum degassing process mechanically flushes waste from the powder. The use of 96% helium and 4% hydrogen vigorously cleans the surface of the metal powder to provide a much higher level of cleanliness on the surface of the powder than helium alone. Helium is selected due to its inert nature and atomic particle size.

Once the containment (10) is connected to the vacuum degassing apparatus (100) a leak test is conducted. Upon conclusion of a satisfactory leak test a vacuum evacuation procedure is followed to bring the pressure within the containment (10) down to an appropriate pressure. Following the vacuum evacuation process the containment is purged with a gas which can be pure helium, 96% helium and 4% hydrogen, or any other suitable gas. The containment (10) is purged with the gas for an appropriate duration. The vacuum and gas purging procedures are repeated one after the other as required.

After completion of the vacuum degassing process, the metal powder is hot Isostatically pressed. The general principles of the hot Isostatic pressing process are applicable across containment designs but temperature and pressure profiles must be considered for each containment design. The integrity of the containment (10) must be considered during the initial stages of the hot Isostatic pressing process when both temperature and pressure are applied to the containment (10).

The invention claimed is:

1. A process for vacuum degassing and hot isostatically pressing a metal powder within a containment comprising a plurality of gas purging pipes and a plurality of gas evacuation pipes, the process comprising:

purging with an inert gas through at least one gas purging pipe of the plurality of gas purging pipes;

evacuating gas in the containment through at least one gas evacuation pipe of the plurality of gas evacuation pipes; and hot isostatically pressing the metal powder after completion of the purging and the evacuating steps;

wherein the process comprises an initial gas purge and at least one subsequent gas purge, and the at least one subsequent gas purge comprises purging with 96% helium and 4% hydrogen.

2. The process according to claim 1, wherein the process comprises a plurality of subsequent gas purges.

3. The process according to claim 1, wherein the inert gas comprises helium.

4. The process according to claim 1, wherein the inert gas comprises helium and at least one other gas.

5. The process according to claim 1, wherein the inert gas is 96% helium and 4% hydrogen.

6. The process according to claim 1, wherein the initial gas purge comprises purging with helium.

7. The process according to claim 1, wherein the initial gas purge comprises purging with pure helium.

8. The process according to claim 1, wherein the at least one subsequent gas purge comprises purging with helium and at least one other gas.

9. The process according to claim 1, wherein each gas purging pipe is diagonally opposite a gas evacuation pipe to encourage gas within the containment to follow a path through the metal powder.

10. The process according to claim 1, further comprising a step of positioning the containment within an oven.

* * * * *